United States Patent [19]

Steverlynck

[11] 4,060,104

[45] Nov. 29, 1977

[54] SLAY FOR WEAVING LOOMS

[75] Inventor: Patrick A. Steverlynck, Vichte, Belgium

[73] Assignee: N.V. Weefautomaten Picanol, Ieper, Belgium

[21] Appl. No.: 720,592

[22] Filed: Sept. 7, 1976

[30] Foreign Application Priority Data

Sept. 19, 1975 Belgium ..... 7511123

[51] Int. Cl.[2] ..... D03D 49/60

[52] U.S. Cl. ..... 139/188 R; 139/449

[58] Field of Search ..... 139/188–191, 139/449, 188 R, 188 A

[56] References Cited

U.S. PATENT DOCUMENTS

| | | | |
|---|---|---|---|
| 1,377,834 | 5/1921 | Holmes | 139/188 R |
| 1,591,483 | 7/1926 | Gordon | 139/188 R |
| 2,493,634 | 1/1950 | Mastriani et al. | 139/188 R |
| 2,496,628 | 2/1950 | Kieley et al. | 139/188 R |
| 2,942,627 | 6/1960 | McDowell | 139/188 R |
| 3,677,306 | 7/1972 | Atkinson | 139/188 R |
| 3,978,898 | 9/1976 | Juillard | 139/188 R |

FOREIGN PATENT DOCUMENTS

| | | | |
|---|---|---|---|
| 53,668 | 8/1967 | Poland | 139/188 R |
| 1,166,358 | 10/1969 | United Kingdom | 139/188 R |

*Primary Examiner*—James Kee Chi

*Attorney, Agent, or Firm*—Bacon & Thomas

[57] ABSTRACT

The invention pertains to an improved slay for weaving looms, consisting of the slay itself and of two slay swords, characterized by the fact that at least the slay swords are built as hollow structures, whereby the head of each slay sword is attached to the corresponding end of the slay and along the extension of same, and whereby the width of the slay swords is greater than that of the slay itself.

5 Claims, 6 Drawing Figures

Fig. 2
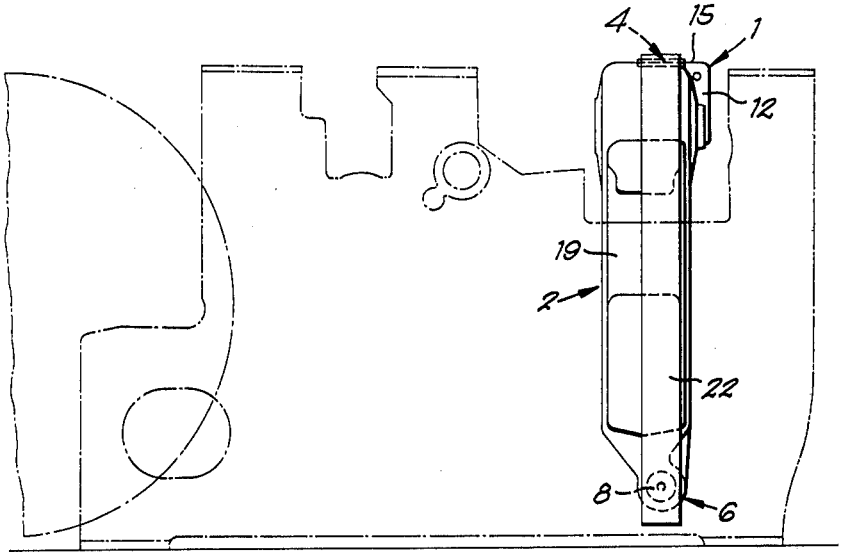
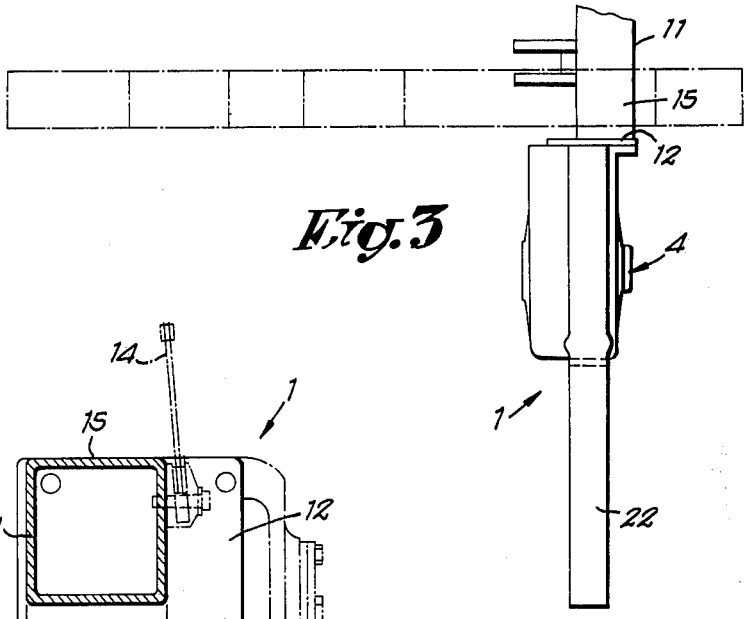
Fig. 3
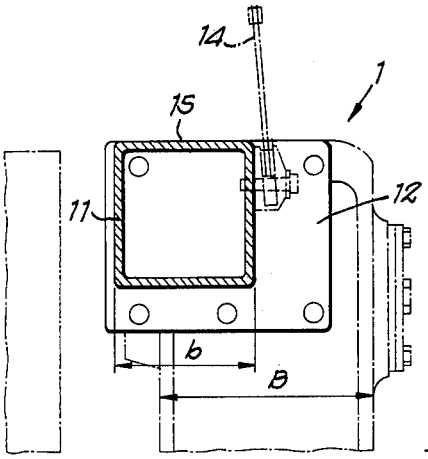
Fig. 5

VI
14
15
11
1
13
5
3
17
16
7
9
VI

SLAY FOR WEAVING LOOMS

The present invention is concerned with an improved slay for weaving looms, and more particularly for high speed looms.

In the case of such looms, the problem always arises, with respect to the slay, of the compromise between weight or mass and rigidity.

As the rigidity of the slay, or respectively of the race board is of capital importance for obtaining flawless fabrics, one has needs been forced to revert to relatively heavy structures.

This is for instance the case in machines of the type in which two grippers, fitted on flexible lances, respectively and alternately pull the weft thread from one end of the slay towards the middle and from the middle to the other end of the slay, as a perfect mutual presentation of the grippers is essential each time in the center of the race board.

The present invention brings a solution to this problem, consisting of a novel construction for the slay, whereby the slay itself and its two slay swords are each built as hollow metal structures, whereby the head of each slay sword is fixed to the corresponding end of the slay along the extension of the latter and whereby furthermore, the width of the slay swords is greater than the width of the slay itself.

A further problem which arises for the construction and the maintenance of weaving looms, is the fitting, or respectively the replacement of the weft entering mechanism. So far, the fitting or respective replacement of afore-mentioned mechanism has called for an operation of considerable duration.

According to the invention, preferably at least one part of the weft entering mechanism is housed in at least one of the aforesaid slay swords, whereby furthermore these slay swords shall preferably be fitted on the outside of the weaving loom frame. This allows aforesaid slay swords to be constructed with the weft entering mechanism incorporated as a single structural unit, which can then be fitted to the loom in a very short time.

For the sake of clarification, a preferred form of embodiment of the invention shall be described in greater detail hereinafter with reference to the appended drawings in which:

FIGS. 2 and 3 are view respectively according to arrows $F_2$ and $F_3$ in FIG. 1;

FIGS. 4 and 5 are cross-sections respectively according to the lines IV—IV and V—V in FIG. 1.

Figure 1:
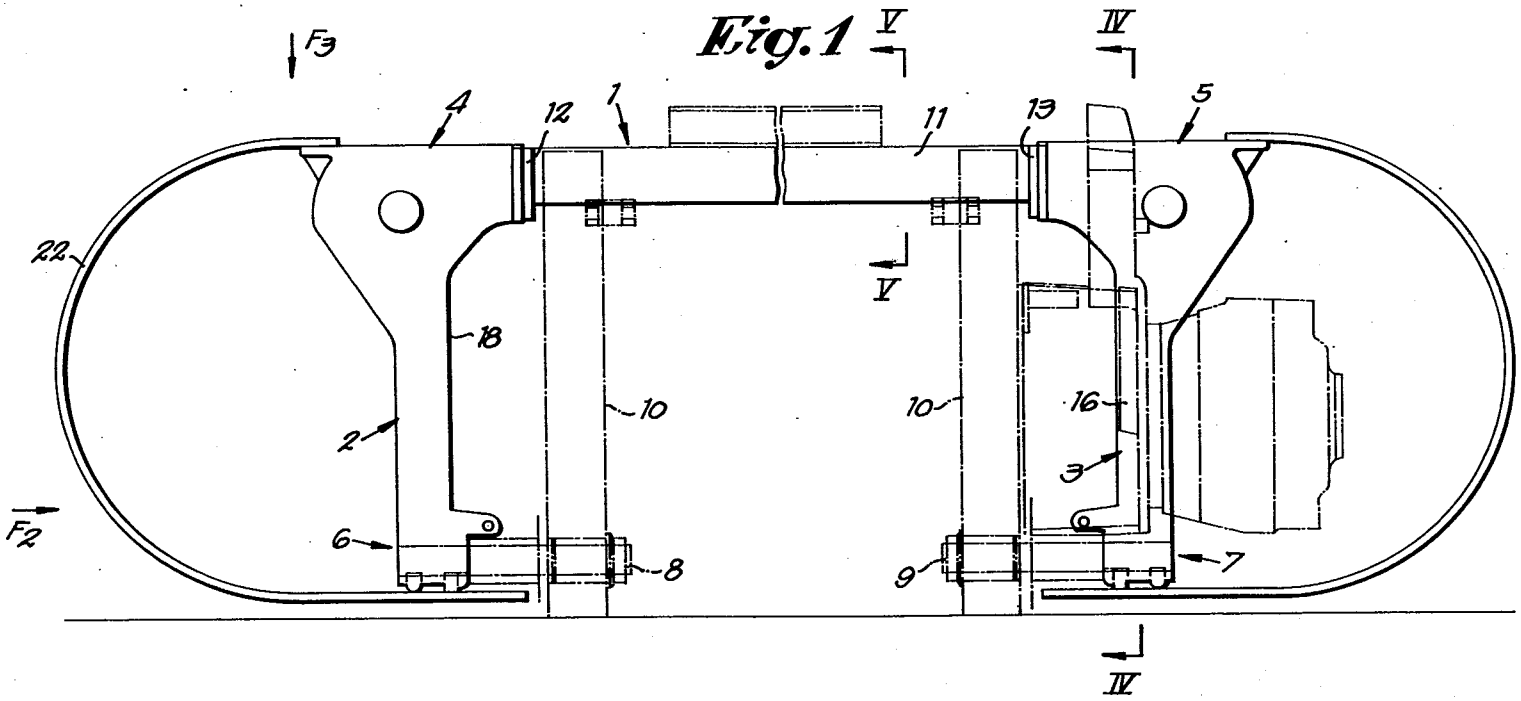
FIG. 1 is a front view of a slay according to the invention.

The slay according to the invention consists of an actual slay 1 and of two slay swords 2 and 3 of which the heads 4 and 5 are fixed to the slay 1 along the extension of the latter, and of which the bottom ends 6 and 7 are fitted hingedly to the frame 10 of the weaving loom by means of pivot pins 8 and 9.

The slay itself consists of a steel pipe with square cross section 11 (FIG. 5) and of two end plates 12 and 13. To the rear side of pipe 11, a reed 10 is attached. The top part of pipe 11 carries the race board 15.

Figure 4:
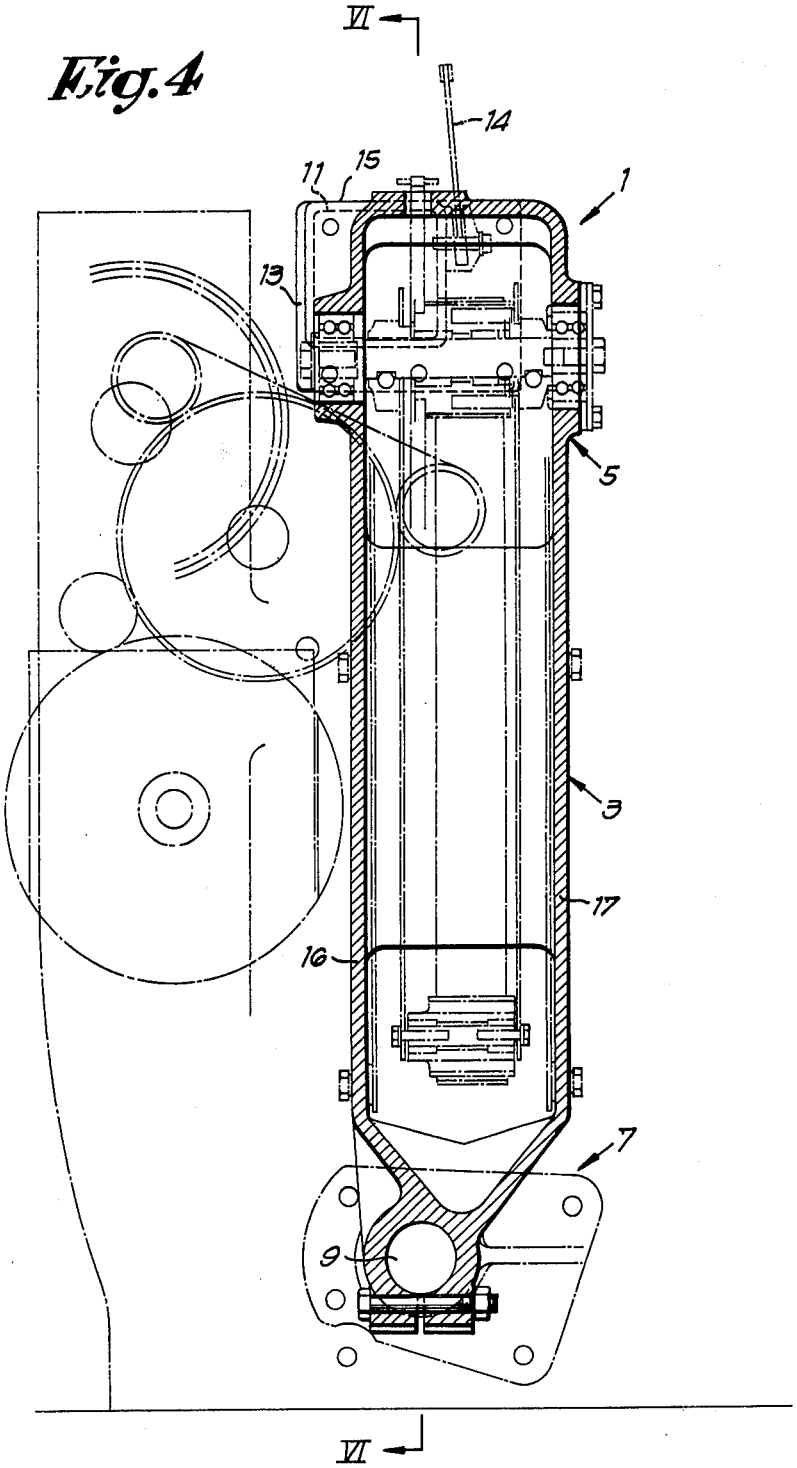

Each slay sword 2 and 3 consists of a hollow casting with continuous side walls 16 and 17 (FIG. 4) and partial end walls 18 and 19.

Figure 6:
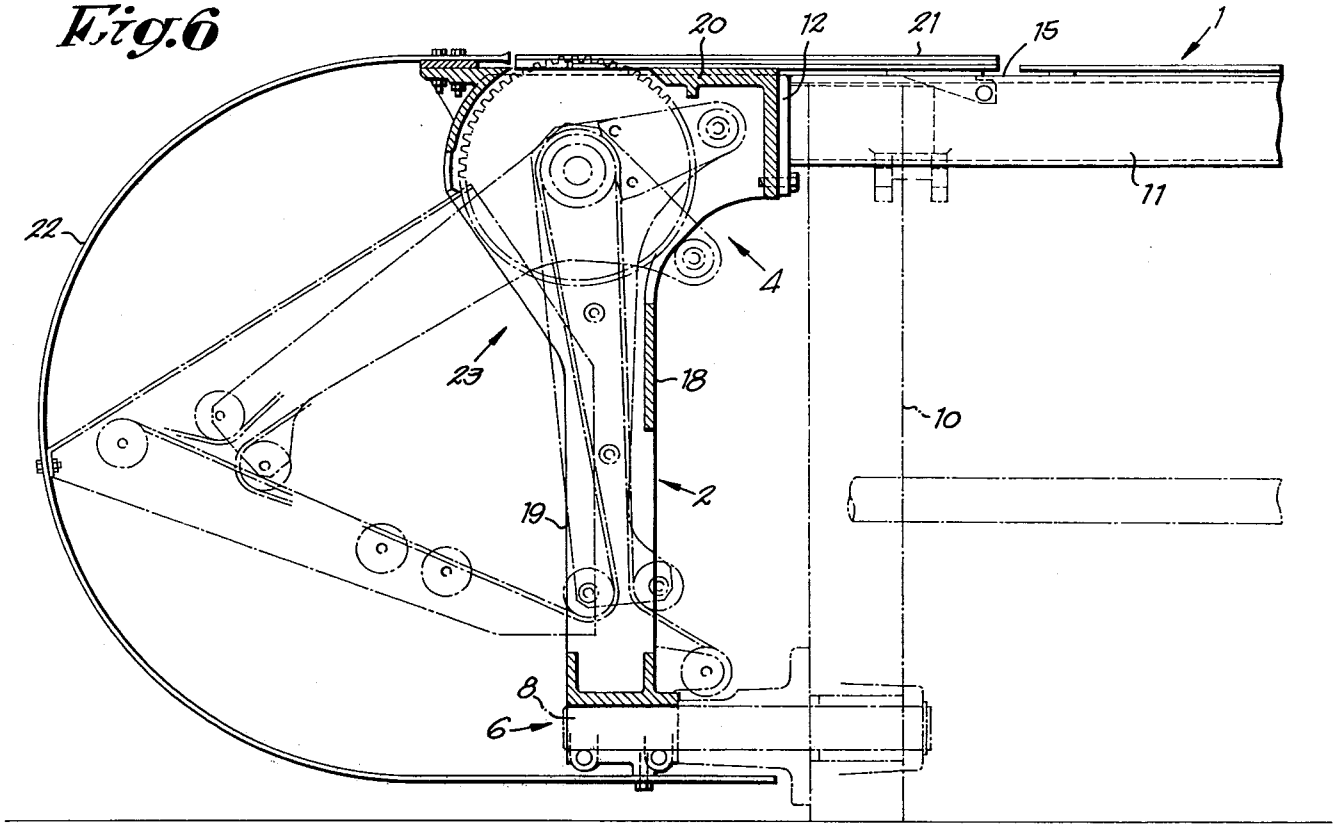
FIG. 6 is a cross-section according to line VI—VI in FIG. 4.

The top part of each head, respectively 4 and 5, is fitted with a plate 20 (FIG. 6) upon which a guiding device 21 for the lance (rapier) is attached. A further guiding device 22 for the lance (rapier) is fixed on the one hand to the head, and on the other hand to the bottom end of each slay sword. In the inner space of each slay sword, a driving mechanism 23 for the lance (rapier) can for the greater part be housed. This driving mechanism may advantageously be of the type described in the application "Mechanical multiplier for weaving looms" Ser. No. 720,593 filed by the applicant simultaneously with the present application, on Sept. 7, 1976.

According to a characteristic of the invention, the width "B" of each slay sword is considerably greater than the width "*b*" of the slay 11 (FIG. 5). This caters on the one hand for the resistance to distortion of the slay swords during the operation of the slay arms, and on the other hand for a sufficient space for the lance (rapier) driving devices.

In order to assure a rapid fitting, or respectively replacement of the slay swords, the latter are fitted on the outside of frame 10 of the weaving loom. The present invention can also be applied to weaving looms with shuttles. At least one of aforesaid slay swords can then be built in such a manner that the head thereof is fitted with a magazine for shuttles, or suchlike.

What I claim is:

1. Improved slay for weaving looms, having a frame supporting a slay itself and two slay swords, characterized by the fact that at least the slay swords are hollow structures with the head of each slay sword attached to the corresponding end of the slay and along the extension of same, the width of slay swords being greater than that of the slay itself, the slay swords being secured to the outer sides of said frame.

2. Improved slay according to claim 1, characterized by the fact that the slay itself consists of a steel pipe of square cross-section and of two end plates of which the surface is greater than that of the cross-section of said pipe.

3. Improved slay according to claim 1, characterized by the fact that at least one part of a weft entering mechanism is housed in at least one of aforesaid slay swords.

4. Improved slay according to claim 3, more particularly for a loom of the type in which two grippers, fitted on flexible lances or rapiers, respectively and alternately pull the weft thread from one end of the slay to the middle thereof, and from the middle to the other end of the slay, characterized by the fact that the driving mechanism for each lance is for the greater part housed within the corresponding slay sword.

5. Improved slay according to claim 4, characterized by the fact that the head of each slay sword is provided with a plate upon which a guiding device for the rapier is fixed.

* * * * *